US008419147B2

(12) United States Patent
Ide et al.

(10) Patent No.: US 8,419,147 B2
(45) Date of Patent: Apr. 16, 2013

(54) FLUID EJECTION DEVICE

(75) Inventors: Noritaka Ide, Shiojiri (JP); Kunio Tabata, Shiojiri (JP); Shinichi Miyazaki, Suwa (JP); Atsushi Oshima, Shiojiri (JP); Hiroyuki Yoshino, Matsumoto (JP); Nobuaki Azami, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 390 days.

(21) Appl. No.: 12/605,480

(22) Filed: Oct. 26, 2009

(65) Prior Publication Data

US 2010/0103213 A1 Apr. 29, 2010

(30) Foreign Application Priority Data

Oct. 27, 2008 (JP) ..... 2008-275235

(51) Int. Cl.
*B41J 29/38* (2006.01)
*B41J 2/045* (2006.01)

(52) U.S. Cl.
USPC ..... 347/10; 347/5; 347/9; 347/68

(58) Field of Classification Search ..... 347/10, 347/20, 72, 68, 5, 9
See application file for complete search history.

(56) References Cited

U.S. PATENT DOCUMENTS

| | | | | |
|---|---|---|---|---|
| 6,276,773 | B1 * | 8/2001 | Takizawa | 347/10 |
| 7,608,979 | B2 * | 10/2009 | Sato et al. | 310/317 |
| 2004/0169545 | A1 * | 9/2004 | Aiba et al. | 327/530 |
| 2007/0076026 | A1 * | 4/2007 | Nakayama | 347/9 |
| 2008/0238964 | A1 * | 10/2008 | Umeda | 347/10 |

FOREIGN PATENT DOCUMENTS

| | | |
|---|---|---|
| JP | 2003-285441 | 10/2003 |
| JP | 2007-301757 A | 11/2007 |
| JP | 2008-023813 A | 2/2008 |
| JP | 2008-143129 A | 6/2008 |

* cited by examiner

*Primary Examiner* — Stephen Meier
*Assistant Examiner* — Sarah Al Hashimi
(74) *Attorney, Agent, or Firm* — Maschoff Brennan

(57) ABSTRACT

A fluid ejection device that ejects fluid from an ejection port includes: a drive element that ejects fluid in accordance with a difference between voltages applied to a first terminal and a second terminal; a drive voltage waveform storing unit that stores a drive voltage waveform applied to the drive element; a plurality of power supplies each having a different voltage; and a drive voltage waveform applying unit that applies the drive voltage waveform to the drive element by switching among the plurality of power supplies connected to the first and second terminals of the drive element.

4 Claims, 11 Drawing Sheets

FIG.6A WHEN TERMINAL B IS CONNECTED TO POWER SUPPLY E1
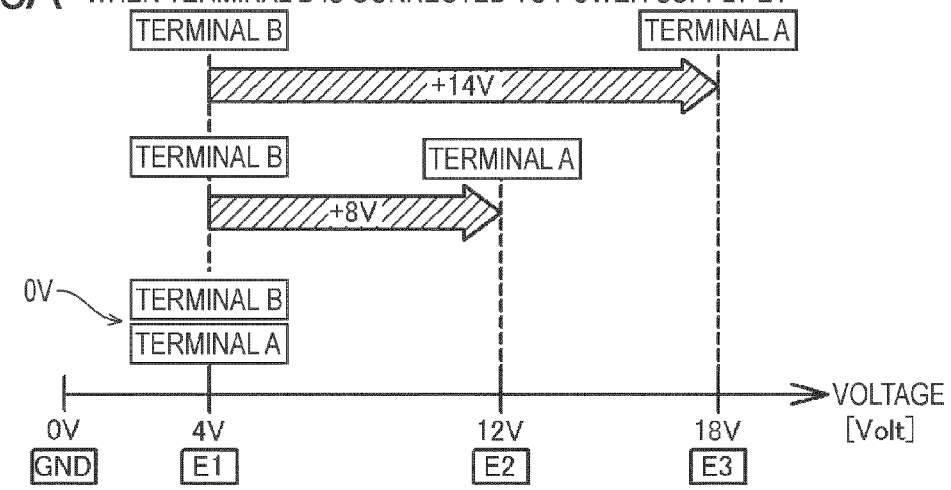
FIG.6B WHEN TERMINAL B IS CONNECTED TO POWER SUPPLY E2
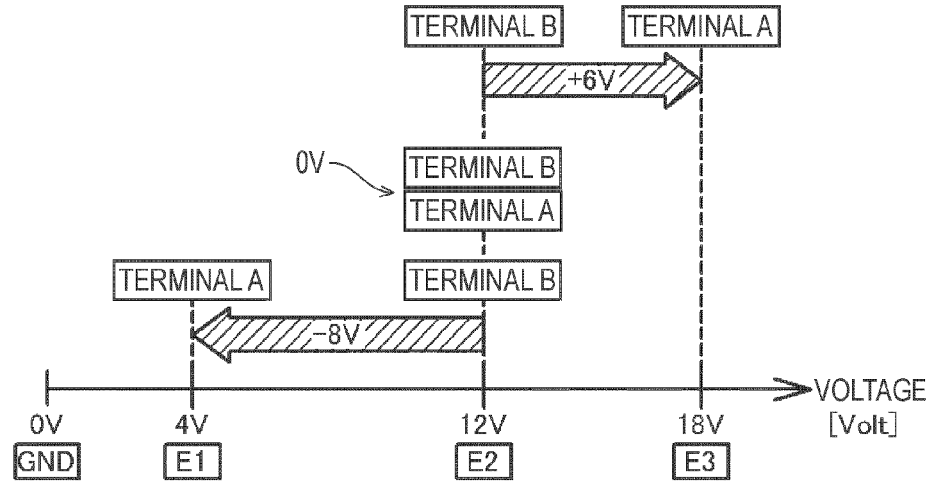
FIG.6C WHEN TERMINAL B IS CONNECTED TO POWER SUPPLY E3
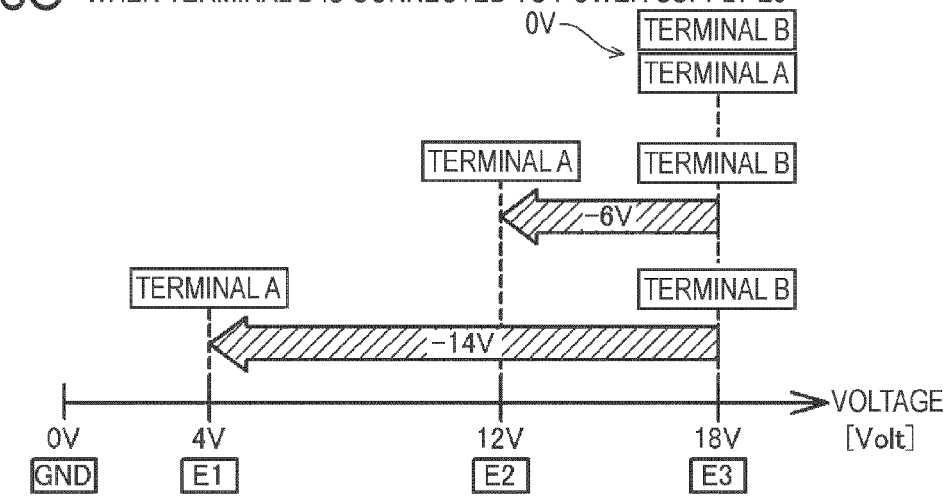

FLUID EJECTION DEVICE

This application claims priority to Japanese Patent Application No. 2008-275235 filed on Oct. 27, 2008, and the entire disclosure thereof is incorporated herein by reference.

BACKGROUND

1. Technical Field

The present invention relates to a technique for ejecting a fluid from an ejection head.

2. Related Art

Inkjet printers that eject ink onto a print medium to print an image have been widely used as image output means nowadays because they can easily print an image of high quality. When, instead of ink, various kinds of fluids (for example, a liquid having fine particles of a functional material dispersed therein or semifluid such as gel) that are each prepared so as to have a proper component are ejected onto a substrate by applying this technique, it is conceivable that various kinds of precision components such as an electrode, a sensor, or a biochip can be easily manufactured.

In such a technique, a special ejection head provided with a fine ejection port is used so that an accurate amount of fluid can be ejected at a correct position. The ejection head is provided with a drive element (for example, piezo element) connected to the ejection port. A fluid is ejected from the ejection port by applying a drive voltage waveform to the drive element. The amount or shape (for example, size of droplet) of the fluid to be ejected from the ejection port can be changed by controlling the drive voltage waveform to be applied to the drive element.

When an amplifying element such as a transistor is used for generating the drive voltage waveform, power consumption is increased because power is lost in the amplifying element (for example, collector dissipation of transistor). Therefore, a technique is proposed in which the drive voltage waveform is generated by storing different voltages in a plurality of capacitors and changing the capacitors at appropriate times to change the voltage without using an amplifying element (JP-A-2003-285441).

In the proposed technique, however, a large number of capacitors are required for ensuring the accuracy of the drive voltage waveform, which causes a problem of an increase in circuit scale. That is, since voltage is output by changing the capacitors each having a different voltage, the number of kinds of voltages to be output is limited to the number of capacitors. Therefore, a large number of capacitors have to be provided for ensuring the accuracy of the drive voltage waveform, resulting in an increase in circuit scale.

SUMMARY

An advantage of some aspects of the invention is to provide a technique that makes it possible to output an accurate drive voltage waveform without increasing a circuit scale while suppressing power consumption in a fluid ejection device, and the following configuration is adopted.

According to an aspect of the invention, a fluid ejection device that ejects a fluid from an ejection port includes: a drive element that ejects fluid from the ejection port in accordance with a difference between voltages applied to a first terminal and a second terminal; a drive voltage waveform storing unit that stores a drive voltage waveform applied to the drive element; a plurality of power supplies with different voltages; and a drive voltage waveform applying unit that applies the drive voltage waveform to the drive element by switching among the plurality of power supplies connected to the first and second terminals of the drive element.

The fluid ejection device according to the aspect of the invention stores the drive voltage waveform applied to the drive element and includes the plurality of power supplies each having a different voltage. The fluid ejection device connects the power supplies to the drive element while changing the power supplies to thereby apply the drive voltage waveform. In this case, the fluid ejection device not only connects the power supply to one terminal of the drive element while changing the power supplies but also connects the power supply to the other terminal while changing them.

In general, the drive element operates in accordance with the potential difference between two terminals. Therefore, when the power supplies are connected to the two terminals of the drive element, a voltage corresponding to the voltage difference between the two connected power supplies is applied to the drive element. When the power supplies are connected to the two terminals of the drive element while changing the power supplies, various voltages can be applied depending on the combination of voltages of two power supplies. Therefore, even when the number of power supplies is limited, a large number of kinds of voltages can be applied. As a result, an accurate drive voltage waveform can be applied without using a large number of power supplies.

In the fluid ejection device according to the aspect of the invention, the power supplies may be divided into two groups, one power supply may be selected from each of the groups, and one of the power supplies and the other power supply may be connected to the first and second terminals of the drive element, respectively.

With this configuration, when a switching switch for selecting one power supply from each of the groups and a switch for connecting the selected power supply of each of the groups to one of the terminals of the drive element are provided, the drive element can be driven. Accordingly, it is not necessary to provide the switch for connecting to one of the terminals of the drive element in the individual power supplies. Therefore, the device configuration can be more simplified.

In the fluid ejection device according to the aspect of the invention, an element (for example, piezo element) that accumulates a charge in accordance with an applied voltage may be used as a drive element. A capacitive element may be connected between the power supplies.

When a drive voltage waveform is applied to the drive element that can accumulate a charge, the charge flows into or flows out of the drive element along with the change in voltage. Therefore, by connecting the capacitive element between the power supplies, the charge of the drive element can be regenerated into the capacitive element when voltage is decreased by changing the power supplies. When voltage is increased, the charge that has been regenerated into the capacitive element can be supplied again to the drive element at this time. Therefore, since not all the charge has to be newly supplied to the drive element every time voltage is applied thereto, the consumption of power can be suppressed.

Since power consumption such as heat generation occurs due to the flow of charge (current) when the charge is collected to the capacitive element, power regeneration efficiency decreases in some cases. Therefore, it is desirable to reduce the difference between the voltage of the drive element and the voltage of the capacitive element to suppress the current. With regard to this point, according to the aspect of the invention, a large number of kinds of voltages can be generated depending on the combination of two power supplies. Therefore, when the capacitive element is connected between two power supplies by which a proper voltage can be provided, it is possible to allow the capacitive element to have a proper voltage to reduce the difference between the voltage of the drive element and the voltage of the capacitive element. As a result, it is possible to keep the current small and suppress power consumption more.

The capacitive element may be any element as long as it can hold a charge. For example, an element that holds a charge by an electromagnetic method, such as so-called a capacitor, may be used, or an element that holds a charge by a chemical method, such as a secondary battery, may be used. In the use of any of the elements, since the charge supplied to the drive element can be regenerated and reused, power consumption can be suppressed more.

According to the aspect of the invention, the power supplies are connected to the drive element while changing them, so that an accurate drive voltage waveform can be applied. In view of this point, the aspect of the invention is not limited to a fluid ejection device but can be applied to various devices using a drive element. Accordingly, the aspect of the invention can be understood as a drive circuit that drives a drive element. That is: the aspect of the invention can be understood as a drive circuit that applies a drive voltage waveform to a drive element that operates in accordance with the difference between voltages to be applied to first and second terminals, including: a drive voltage waveform storing unit that stores the drive voltage waveform; a plurality of power supplies each having a different voltage; and a drive voltage waveform applying unit that connects the plurality of power supplies to the terminals of the drive element while changing the plurality of power supplies to thereby apply the drive voltage waveform to the drive element, wherein the drive voltage waveform applying unit selects two power supplies among the plurality of power supplies in accordance with the voltage of the drive voltage waveform to connect one of the two power supplies to the first terminal of the drive element and connect the other to the second terminal, thereby changing the power supplies to be connected to the drive element.

Also in the drive circuit according to the aspect of the invention that can be understood as such a form, the drive voltage waveform to be applied to the drive element is stored and the plurality of power supplies each having a different voltage are included. The drive circuit connects the power supplies to the terminals of the drive element while changing the power supplies to thereby apply the drive voltage waveform.

Thus, since various kinds of voltages can be applied depending on the combination of voltages of two power supplies to be connected to the drive element, a large number of kinds of voltages can be applied even when the number of power supplies is limited. As a result, it is possible to apply an accurate drive voltage waveform to accurately control the drive element without using a large number of power supplies.

BRIEF DESCRIPTION OF THE DRAWINGS

The invention will be described with reference to the accompanying drawings, wherein like numbers reference like elements.

FIGS. 6A to 6C are explanatory views showing voltages applied to a piezo element when the terminal B of the piezo element is switched among power supplies E1 to E3.

DESCRIPTION OF EXEMPLARY EMBODIMENTS

Hereinafter, an embodiment and modified examples will be described for making clear the contents of the invention according to the following order.

A. Device Configuration

B. Drive Voltage Waveform Generating Circuit of Embodiment

C. Modified Examples

C-1. First Modified Example

C-2. Second Modified Example

A. Device Configuration

Figure 1:
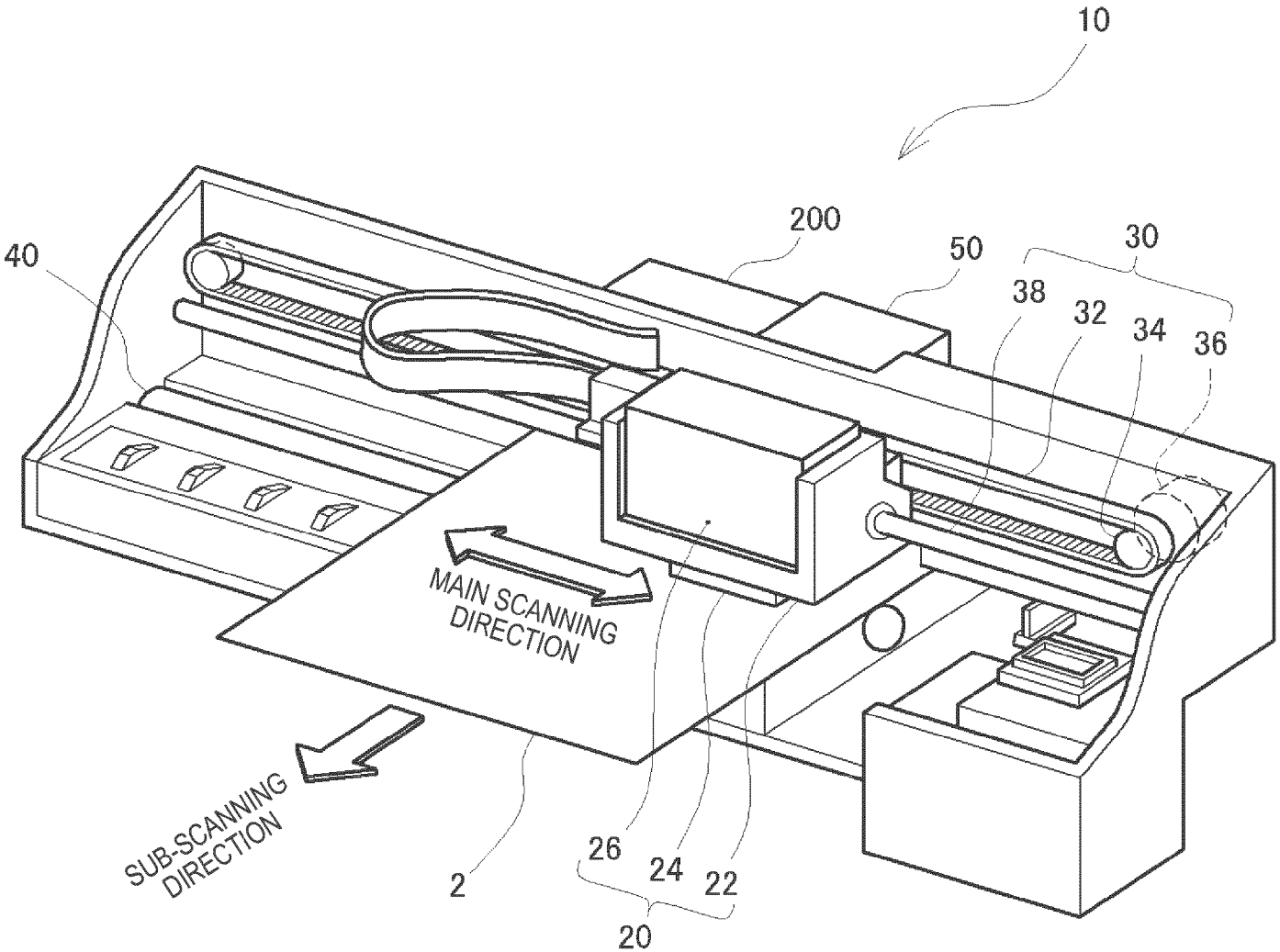
FIG. 1 is an explanatory view schematically showing the configuration of a fluid ejection device of an embodiment using an inkjet printer as an example.

FIG. 1 is an explanatory view schematically showing the configuration of a fluid ejection device of the embodiment using an inkjet printer as an example. As shown in the drawing, an inkjet printer 10 includes a carriage 20 that forms an ink dot on a print medium 2 while reciprocating in a main scanning direction, a drive mechanism 30 that makes the carriage 20 reciprocate, and a platen roller 40 for feeding the print medium 2.

The carriage 20 is provided with an ink cartridge 26 accommodating ink therein, a carriage case 22 into which the ink cartridge 26 is loaded, an ejection head 24 that is mounted on the bottom side (side facing the print medium 2) of the carriage case 22 to eject ink, and the like. The carriage 20 can guide the ink in the ink cartridge 26 to the ejection head 24 and eject an accurate amount of ink from the ejection head 24 to the print medium 2.

The drive mechanism 30 that makes the carriage 20 reciprocate includes a guide rail 38 extending in the main scanning direction, a timing belt 32 having a plurality of teeth formed therein, a drive pulley 34 that meshes with the teeth of the timing belt 32, and a step motor 36 for driving the drive pulley 34. A part of the timing belt 32 is fixed to the carriage case 22 so that the carriage case 22 can be moved accurately along the guide rail 38 with the driving of the timing belt 32.

The platen roller 40 for feeding the print medium 2 is driven by a not-shown drive motor or gear mechanism, so that the platen roller 40 can feed the print medium 2 in a sub-scanning direction at a predetermined amount. Each of the mechanisms is controlled by a printer control circuit 50 mounted on the inkjet printer 10. The inkjet printer 10 drives the ejection head 24 with the use of the mechanisms to eject ink while feeding the print medium 2, thereby printing an image on the print medium 2.

Figure 2:
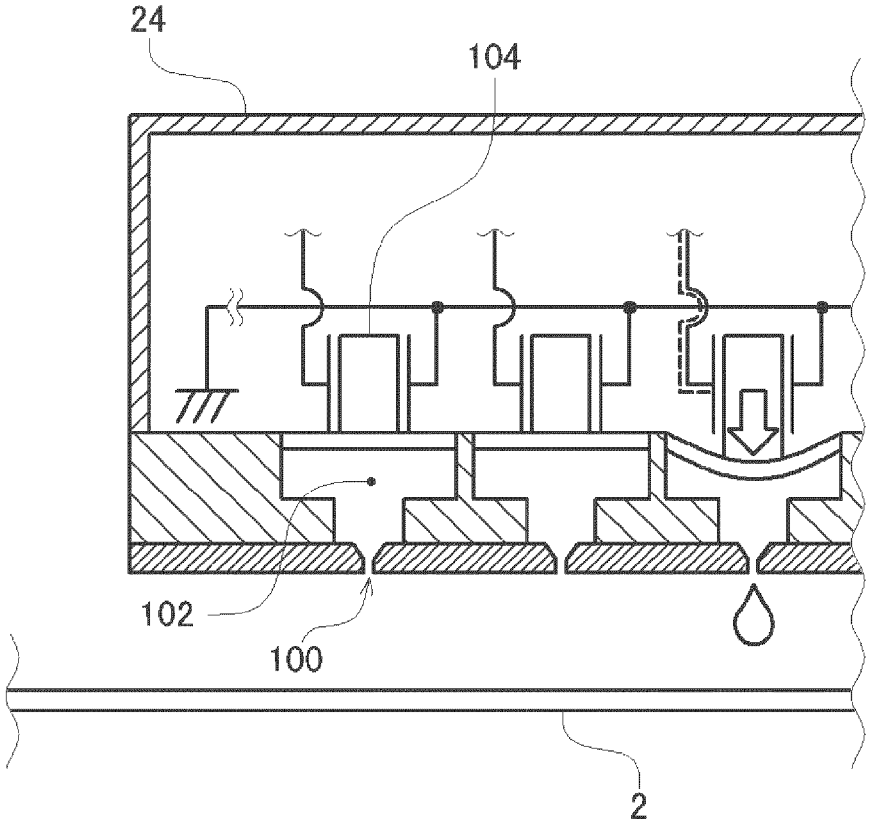
FIG. 2 is an explanatory view specifically showing the internal mechanism of an ejection head 24.

FIG. 2 is an explanatory view specifically showing the internal mechanism of the ejection head 24. As shown in the drawing, a plurality of ejection ports 100 are disposed on the bottom face (face facing the print medium 2) of the ejection head 24. An ink drop can be ejected from each of the ejection ports 100. Each of the ejection ports 100 is connected to an ink chamber 102 in which ink supplied from the ink cartridge 26 is filled.

A piezo element 104 is disposed on each of the ink chambers 102. When voltage is applied to the piezo element 104, the piezo element is deformed to pressurize the ink chamber 102, whereby an ink drop can be ejected from the ejection port 100. Since the deformation amount of the piezo element 104 varies depending on an applied voltage, the size of an ink drop to be ejected can be changed by adjusting the pressing force or pressing timing of the ink chamber 102 when the voltage to be applied to the piezo element 104 is properly controlled. Therefore, the inkjet printer 10 applies a voltage waveform having the following shape to the piezo element 104.

Figure 3:
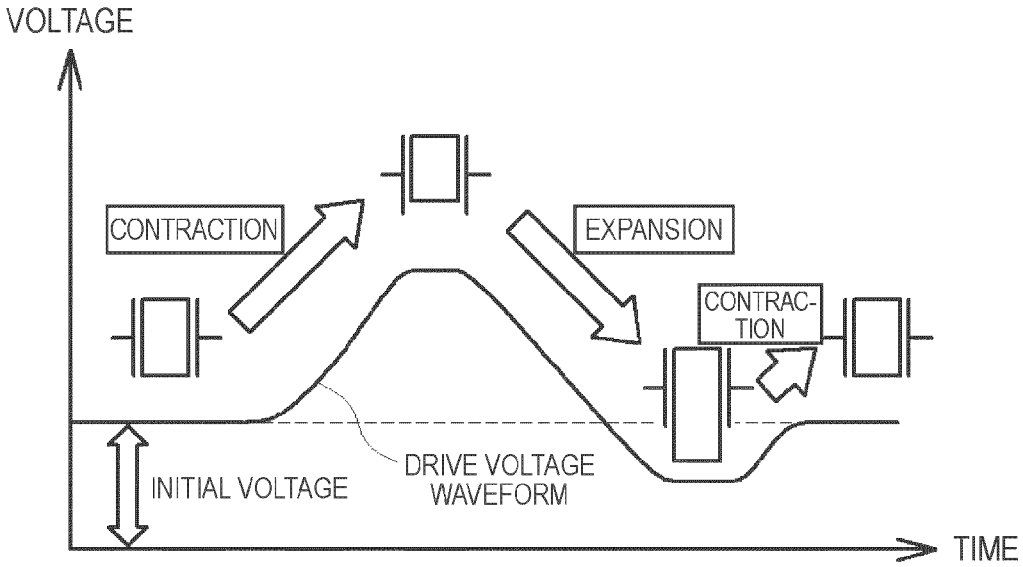
FIG. 3 is an explanatory view illustrating a voltage waveform (drive voltage waveform) to be applied to a piezo element.

FIG. 3 is an explanatory view illustrating a voltage waveform (drive voltage waveform) to be applied to a piezo element. As shown in the drawing, the drive voltage waveform has a trapezoidal shape in which the voltage rises with the lapse of time and thereafter drops and returns to its original voltage. FIG. 3 also shows the state where the piezo element expands and contracts in accordance with the drive voltage waveform. As shown in the drawing, as the voltage of the drive voltage waveform rises, the piezo element gradually contracts in response thereto. In this case, since the ink chamber expands so as to be pulled by the piezo element, ink can be supplied from the ink cartridge into the ink chamber.

After rising and reaching the peak, the voltage starts to drop. At this time, the piezo element expands to compress the ink chamber, thereby ejecting the ink from the ejection port. In this case, the drive voltage waveform drops to a lower voltage than the original voltage (voltage indicated as "initial voltage" in the drawing), which can expand the piezo element more than in the initial state to sufficiently push the ink out. Thereafter, the drive voltage waveform returns to the initial voltage. The piezo element also returns to the initial state in response thereto and prepares for the next operation.

In this manner, since the piezo element expands and contracts in accordance with the drive voltage waveform, it is important for accurately controlling the size of the ink drop to be ejected to generate the drive voltage waveform with high accuracy and apply the generated drive voltage waveform to the piezo element. When an amplifying element such as a transistor is used for generating the drive voltage waveform, there arises a disadvantage such as an increase in power consumption because of the loss in the amplifying element (collector dissipation or the like) as described above. In view of the point, the inkjet printer 10 of the embodiment generates the drive voltage waveform by changing a plurality of power supplies to change voltage without using the amplifying element.

When the drive voltage waveform is generated by changing a plurality of power supplies, the number of kinds of voltages to be output is limited to the number of power supplies as described above. Therefore, a large number of power supplies have to be prepared for ensuring the accuracy of the drive voltage waveform, which causes a disadvantage such as an increase in size of the device. The inkjet printer 10 of the embodiment can generate an accurate drive voltage waveform without using a large number of power supplies while enabling power saving by using the following circuit configuration to change power supplies.

B. Drive Voltage Waveform Generating Circuit of Embodiment

Figure 4:
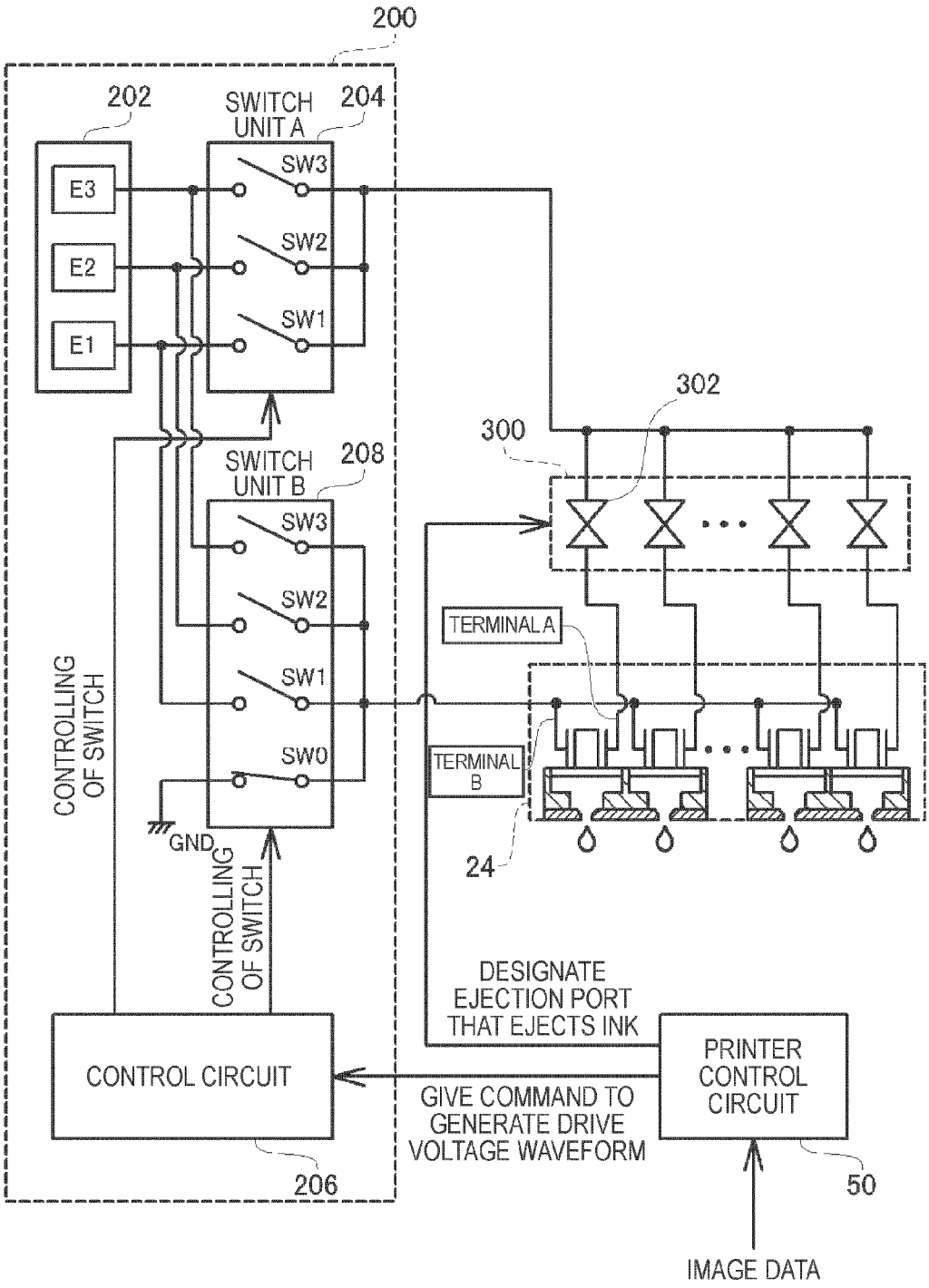
FIG. 4 is an explanatory view showing a drive voltage waveform generating circuit and the circuit configuration in the vicinity thereof.

FIG. 4 is an explanatory view showing a drive voltage waveform generating circuit and the circuit configuration in the vicinity thereof according to the embodiment. As shown in the drawing, a drive voltage waveform generating circuit 200 includes a power supply unit 202, two switch units of a switch unit A204 and a switch unit B208, and a control circuit 206 that controls the power supply unit 202 and each of the switch units. The power supply unit 202 is a power supply module having a plurality of power supplies provided therein and can output voltage from each of the power supplies.

For facilitating the description, it is assumed in the embodiment that the power supply unit 202 is provided with three power supplies (power supplies E1 to E3) in which the power supply E1 has the lowest voltage level followed by the power supply E2 and the power supply E3. Each of the power supplies E1 to E3 may be any power supply as long as it can generate voltage. For example, a power supply circuit such as a constant voltage circuit may be used, or a storage element such as a battery or capacitor may be used.

Output of each of the power supplies of the power supply unit 202 is connected to the switch unit A204. Each of switches SW1 to SW3 of the switch unit A204 is operated to change the three power supplies for changing voltage, so that a voltage waveform can be generated. For example, in the state where only the switch SW1 is turned on, and the other switches are turned off, since only the power supply E1 is connected, the voltage of the power supply E1 is output from an output terminal of the switch unit A204. When the state is changed at this time to the state where the switch SW2 is turned on, and the other switches are turned off, the voltage of the power supply E2 is output at this time. Similarly, when the SW3 is turned on, and the other switches are turned off, the voltage of the power supply E3 is output at this time. In this manner, when the switches SW1 to SW3 are sequentially turned on, a voltage waveform in which the voltage rises from the voltage of the power supply E1 to the voltage of the power supply E3 can be output.

Each of the power supplies of the power supply unit 202 is also connected to the switch unit B208, so that output of each of the power supplies can be applied to a terminal (terminal indicated as "terminal B" in the drawing) of a piezo element via the switch unit B208 as shown in the drawing. The drive voltage waveform generating circuit 200 of the embodiment can apply an accurate drive voltage waveform to the piezo element by operating the switch unit B208 in addition to the switch unit A204. This point will be described in detail later.

On the other hand, output of the switch unit A204 is connected to a gate unit 300 as shown in the drawing. The gate unit 300 has a structure in which a plurality of gate elements 302 are connected in parallel to one another. The piezo element 104 is connected to each of the gate elements 302. The gate elements 302 can be individually brought into a conductive state or a cutting-off state. When only the gate element 302 of an ejection port from which ink is to be ejected is brought into the conductive state, voltage can be applied only to the corresponding piezo element 104, and an ink drop can be ejected from the ejection port.

The drive voltage waveform generating circuit 200 and the gate unit 300 are connected to a printer control circuit 50, so that they are driven in accordance with a command of the printer control circuit 50. The printer control circuit 50 ejects an ink drop by using the circuit configurations as follows. First, based on image data to be printed, the printer control circuit 50 determines an ejection port that ejects an ink drop, and the size of an ink drop to be ejected. Further in accordance with the size of the ink drop to be ejected, the printer control circuit 50 determines a voltage waveform (drive voltage waveform) for ejecting the ink drop having the size.

The printer control circuit 50 sends a command to the gate unit 300 to bring the gate element 302 corresponding to the ejection port into the conductive state as well as sends a command to the drive voltage waveform generating circuit 200 to generate the determined voltage waveform. In response to the instruction, the drive voltage waveform generating circuit 200 sequentially switches the switches of the switch unit to generate the drive voltage waveform and applies the drive voltage waveform to the piezo element 104 of the designated ejection port via the gate element 302. Thus, an ink drop having an intended size is ejected from an intended ejection port.

In this manner, the inkjet printer 10 of the embodiment generates a drive voltage waveform with the drive voltage waveform generating circuit 200 and applies the generated drive voltage waveform to a predetermined piezo element, thereby ejecting an ink drop from an ejection port. In the drive voltage waveform generating circuit 200 of the embodiment, the power supplies E1 to E3 can be connected not only to one terminal of the piezo element but also to the other terminal (terminal indicated as "terminal B" in the drawing). Therefore, an accurate drive voltage waveform can be generated without using a large number of power supplies. Hereinafter, this point will be described in detail. For facilitating the understanding of the description, the case where the terminal B of the piezo element is fixed in the state of being connected to GND (refer to FIG. 4) will be first described. The voltages of the power supplies E1 to E3 are assumed as +4 V, +12 V, and +18 V, respectively, in the description.

Figure 5A:
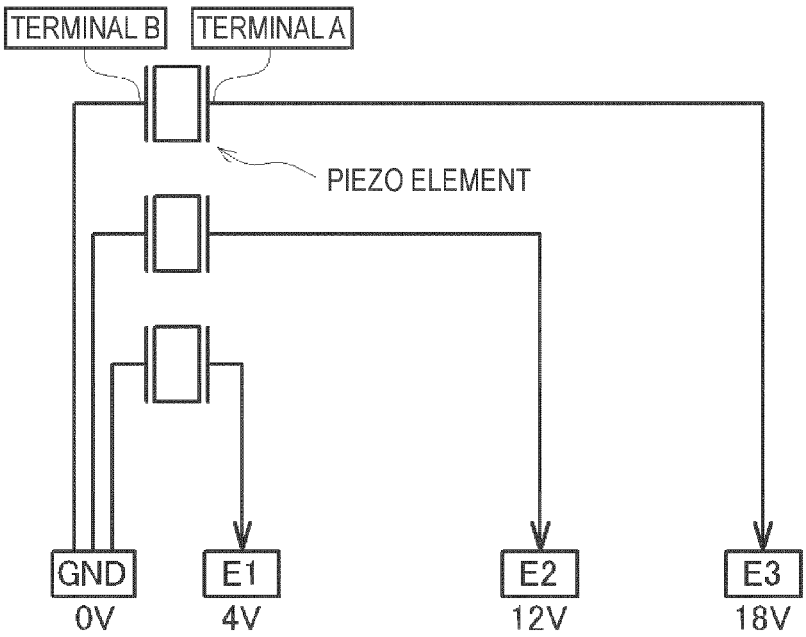
FIGS. 5A and 5B are explanatory views showing voltages to be applied to a piezo element in the state where terminal B of the piezo element is fixed to GND.
Figure 5B:
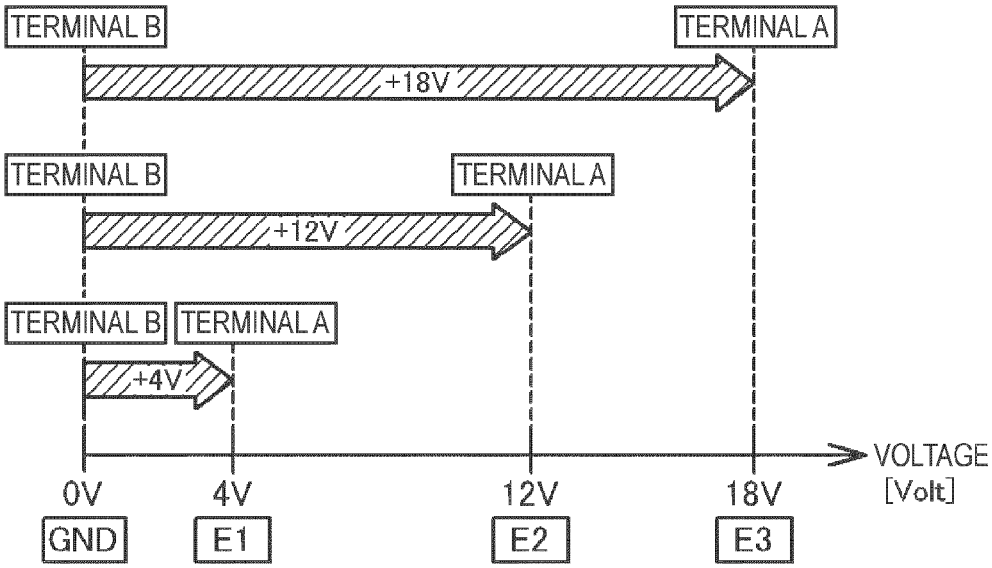

FIGS. 5A and 5B are explanatory views showing voltages to be applied to a piezo element in the state where the terminal B of the piezo element is connected to GND. As shown in FIG. 5A, in the state where the terminal B of the piezo element is connected to GND, three connection states are conceivable depending on to which of the power supplies E1 to E3 the terminal A is connected (refer to solid arrows in the drawing). In correspondence thereto, FIG. 5B shows voltages applied to the piezo element in the respective connection states. For example, in the state shown in the uppermost portion of FIG. 5B, the terminal A of the piezo element is connected to the power supply E3, so that a voltage of +18 V as the voltage of the power supply E3 is applied to the piezo element.

Similarly, in the second state in the drawing, a voltage of +12 Vas the voltage of the power supply E2 is applied. In the state shown in the lowermost portion of the drawing, a voltage of +4V as the voltage of the power supply E1 is applied. In this manner, in the state where the terminal B is fixed to GND, the voltages (+4 V, +12 V, and +18 V) of the respective power supplies E1 to E3 are applied to the piezo element, so that the number of kinds of applicable voltages is limited to three, which is the same number as that of the power supplies. On the other hand, when the terminal B of the piezo element is also switched among the power supplies E1 to E3, voltages different from the voltages of the power supplies can be applied as shown below. As a result, it is possible to greatly increase the kinds of applicable voltages more than the number of power supplies.

FIGS. 6A to 6C are explanatory views showing voltages that can be applied to a piezo element when the terminal B of the piezo element is connected to each of the power supplies E1 to E3. FIG. 6A shows the case where the terminal B is connected to the power supply E1. FIGS. 6B and 6C show the case where the terminal B is connected to the power supply E2 and the case where the terminal B is connected to the power supply E3, respectively. In general, a piezo element operates in accordance with the voltage between two terminals (difference between the potential of one terminal and the potential of the other terminal). Therefore, when the terminal B is also connected to the power supply as described above, a difference voltage obtained by subtracting the voltage of the power supply connected to the terminal B from the voltage of the power supply connected to the terminal A is applied to the piezo element.

For example, in the state shown in the uppermost portion of FIG. 6A, the power supply E3 is connected to the terminal A, and the power supply E1 is connected to the terminal B. Therefore, a voltage of +14 V obtained by subtracting the voltage +4V of the power supply of the terminal B from the voltage +18 V of the power supply of the terminal A is applied to the piezo element. Similarly, when the terminal A is connected to the power supply E2 (refer to the middle stage in the drawing), a difference of +8 V between the voltage +12 V of the power supply E2 and the voltage +4 V of the power supply E1 is applied to the piezo element.

When both the terminals A and B are connected to the power supply E1 (refer to the lower stage in the drawing), the difference between voltages of two power supplies is zero. Therefore, a voltage of 0V is applied to the piezo element. In this manner, when the terminal B is connected to the power supply E1, the voltage corresponding to the difference between the voltage of the power supply (power supplies E1 to E3) to which the terminal A is connected and the voltage of the power supply E1 is applied to the piezo element. Therefore, voltages (+14 V, +8 V, and 0 V in the example shown in the drawing) different from the voltages of the power supplies E1 to E3 can be applied.

Similarly, also when the terminal B is connected to the power supply E2 or to the power supply E3, the voltage corresponding to the difference between the voltage of the power supply to which the terminal A is connected and the voltage of the power supply to which the terminal B is connected can be applied to the piezo element. Thus, as shown in FIGS. 6B and 6C, voltages different from the voltages of the power supplies can be applied to the piezo element. In the state shown in the lowermost portion of FIG. 6B or the state shown in FIG. 6C, the voltage of the terminal A is lower than that of the power supply of the terminal B. In this case, since a negative voltage is obtained by subtracting the voltage of the terminal B from the voltage of the terminal A, the negative voltage is applied to the piezo element as shown in the drawing. In this manner, when the terminal B of the piezo element is connected to the power supply, it is possible to apply a voltage different from the voltage of each of the power supplies. Further, it is also possible to apply a negative voltage.

Figure 7:
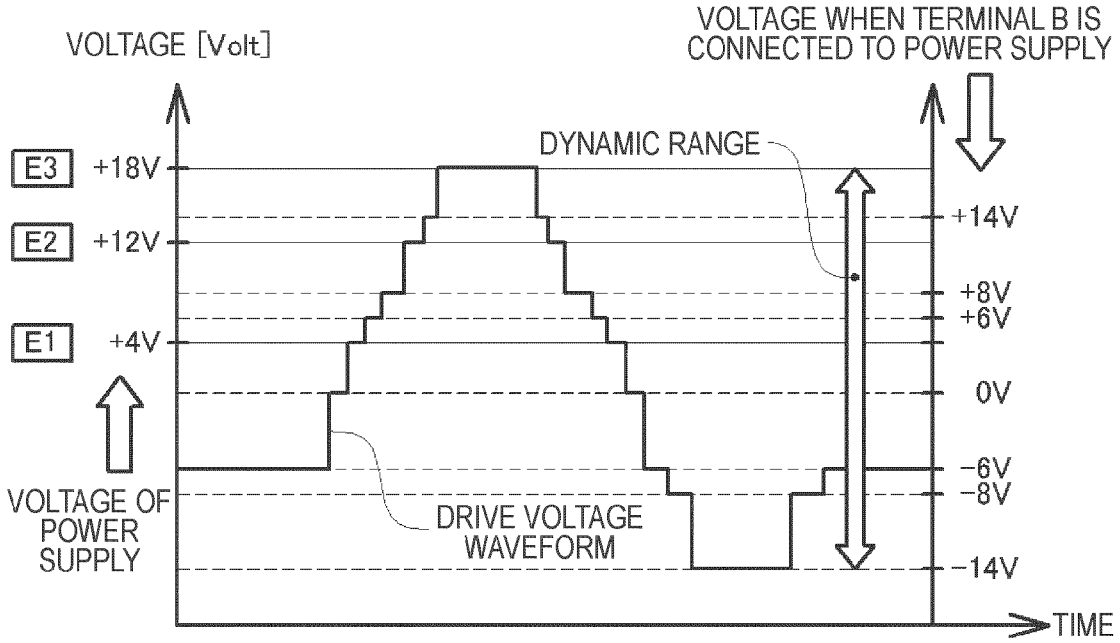
FIG. 7 is an explanatory view illustrating voltages that can be output by the drive voltage waveform generating circuit of the embodiment.

FIG. 7 is an explanatory view showing the state where a large number of voltages can be output by connecting the terminal B of the piezo element to the power supply as described above. A longitudinal axis on the left in the drawing shows the voltages of the power supplies E1 to E3. On the other hand, a longitudinal axis on the right in the drawing shows voltages that can be output by changing the power supplies to be connected to the terminal B of the piezo element. As shown in the drawing, the number of voltages can be greatly increased compared with the number of voltages (voltages indicated by solid lines) of the power supplies, so that the gap between the voltages can be set more finely. As a result, as indicated by a solid line in the drawing, voltage can be changed with fine steps to output an accurate drive voltage waveform.

As shown in the drawing, since a negative voltage can also be output, the range of voltage (so-called dynamic range) that can be applied to the piezo element can be widened. For example, in the example of FIG. 7, a minimum value of voltage is reduced to −14 V as the result that the negative voltage can be applied. The dynamic range is 32 V, which is the difference between a maximum value of +18 V of the voltage and the minimum value of −14 V (refer to a hollow arrow in the drawing). On the other hand, when the power supplies of the power supply unit are used ordinarily, the dynamic range is limited to 18 V from 0 V to +18 V. In this manner, it is possible to apply voltages in a wide range by connecting the terminal B of the piezo element to the power supply for widening the dynamic range.

Figure 8:
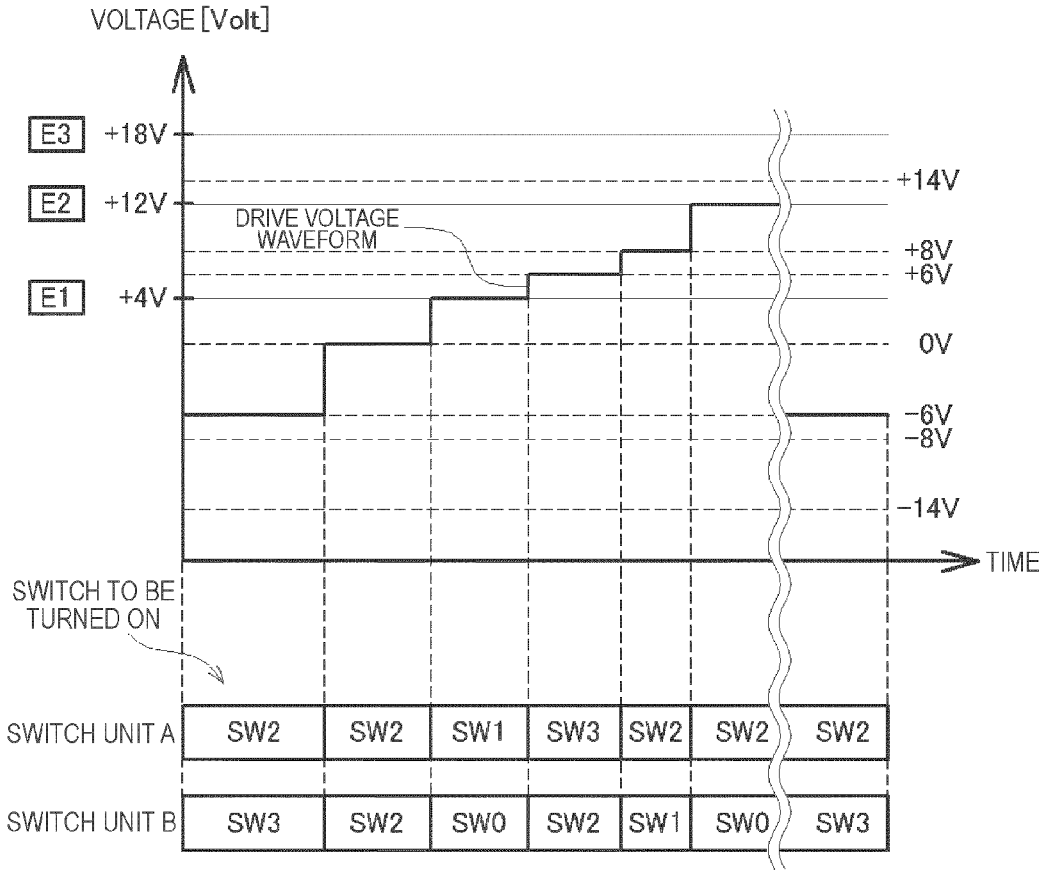
FIG. 8 is an explanatory view illustrating the state of switch units when a drive voltage waveform is output.

For reference purposes, the state of the switch units when outputting a drive voltage waveform is illustrated in FIG. 8. As described above, in the drive voltage waveform generating circuit 200 of the embodiment, the power supplies to be connected to the piezo element are changed by operating the switch units. As a result, since various kinds of voltages are applied to the piezo element, the respective voltages can be associated with the states of the switch units. For example, in the drive voltage waveform shown in FIG. 8, a voltage of −6 V is first applied. This state corresponds to the state where the SW2 of the switch unit A and the SW3 of the switch unit B are turned on as shown in the lower portion of the drawing.

Similarly, the state of 0 V corresponds to the state where the SW2 of the switch unit A and the SW2 of the switch unit B are turned on. Other voltages also respectively correspond to the states shown in the drawing. In this manner, the respective voltages of the drive voltage waveform can be associated with the states of the switch units. Therefore, when generating the drive voltage waveform, the drive voltage waveform can be rapidly generated by operating the switch units to bring the switch units into the state corresponding to the voltage of the drive voltage waveform.

As described above, in the drive voltage waveform generating circuit 200 of the embodiment, since not only one terminal of the piezo element but also the other terminal can be connected to the power supply, a large number of voltages can be output. As a result, an accurate drive voltage waveform can be applied to the piezo element. Thus, the inkjet printer 10 of the embodiment can accurately control the piezo element to eject an ink drop of a correct size. Further, the inkjet printer 10 can print an image of high quality.

It is apparent that since there is no necessity to provide a large number of power supplies for outputting a large number of voltages, the device is not increased in size. Further, since the drive voltage waveform is generated by changing the power supplies, power is not lost unlike the case of using an amplifying element, so that power consumption can be suppressed. Thus, the inkjet printer 10 of the embodiment can print an image of high quality with small power while maintaining the device configuration simple.

Since the inkjet printer 10 of the embodiment has a wide dynamic range of voltage and can apply voltages in a wide range, the inkjet printer 10 can properly drive the piezo element to eject an ink drop with higher accuracy. That is, as described above with reference to FIG. 3, a portion of the drive voltage waveform where the voltage reaches a maximum value corresponds to the state where the piezo element contracts, while a portion where the voltage reaches a minimum value corresponds to the state where the piezo element expands. Therefore, it is possible to eject an ink drop with high accuracy by widening the dynamic range to sufficiently ensuring the stroke of the piezo element.

Further, it is also possible to make the stroke larger to eject a larger ink drop. In the drive voltage waveform generating circuit 200 of the embodiment, since a wide dynamic range can be obtained only by operating the switch units, there is no necessity to provide a power supply having a high voltage for ensuring the dynamic range. Therefore, it is possible to decrease the size of the device by using a simpler power supply.

In the above-described embodiment, although the number of power supplies of the power supply unit is three, it is apparent that the number of power supplies is not limited to three. More power supplies may be provided. As described above, in the drive voltage waveform generating circuit of the embodiment, a voltage to be applied is determined depending on the combination of two power supplies connected to a piezo element. Therefore, the number of voltages can be dramatically increased only by slightly increasing the number of power supplies. Thus, it is possible to generate an extremely accurate drive voltage waveform without greatly complicating the device configuration.

The power supply unit may be provided with an output terminal connected to GND in addition to the power supplies. The output terminal connected to GND can be deemed as a power supply having a voltage of 0 V. Therefore, when the power supply unit is provided with such a power supply, a large number of kinds of voltages can be generated to generate an accurate drive voltage waveform by operating the switch units A and B. With this configuration, the number of voltages can be increased only by the connection to GND without newly providing a power supply. Therefore, the number of voltages can be easily increased, which is preferable.

C. Modified Examples

C-1. First Modified Example

In the drive voltage waveform generating circuit of the above-described embodiment, each of the power supplies is connected to both the switch units A and B and changed in each of the switch units (refer to FIG. 4). Therefore, a large number of switches are required. With the following configuration, however, the number of switches can be decreased to the same extent as the number of power supplies, so that the device configuration can be more simplified.

Figure 9:
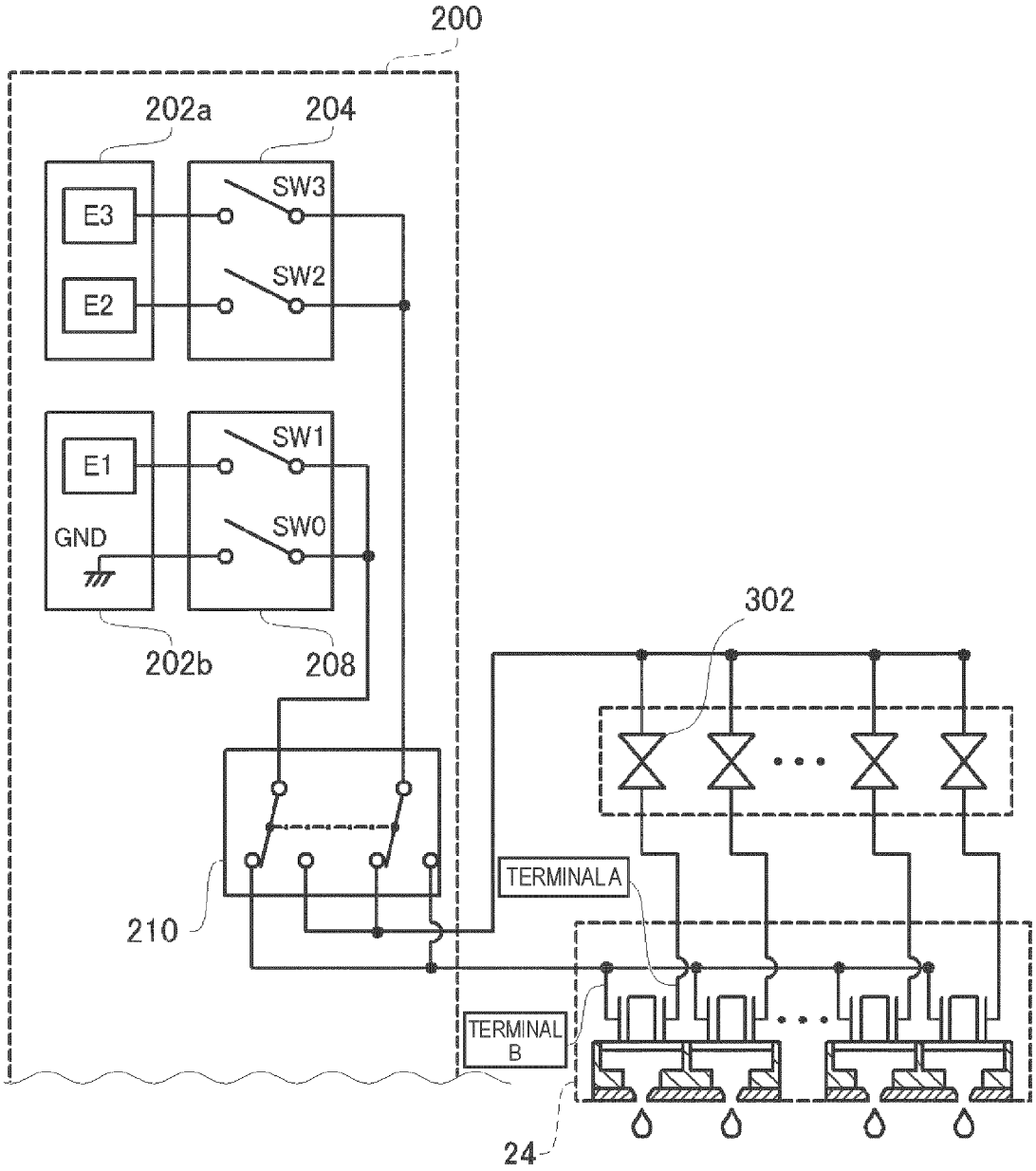
FIG. 9 is an explanatory view showing a drive voltage waveform generating circuit of a first modified example in which the number of switches is reduced.

FIG. 9 is an explanatory view showing a drive voltage waveform generating circuit of a first modified example. As shown in the drawing, in the drive voltage waveform generating circuit of the modified example, a power supply unit is divided into a power supply group A202*a* including the power supplies E3 and E2 and a power supply group B202*b* including the power supply E1 and GND. Each of the power supplies of the power supply group A is connected to the switch unit A, while each of the power supplies of the power supply group B is connected to the switch unit B. That is, since only one switch is connected to each of the power supplies, the total number of switches in each of the switch units is decreased to the same extent as the number of power supplies.

In the drive voltage waveform generating circuit of the modified example, one power supply can be selected from each of the power supply groups by operating the switch units A and B. The two selected power supplies are connected to both terminals of a piezo element via a reverse connection switch 210. By the switching of the reverse connection switch 210, a power supply connected to the terminal A and a power supply connected to the terminal B can be exchanged.

Figure 10A:
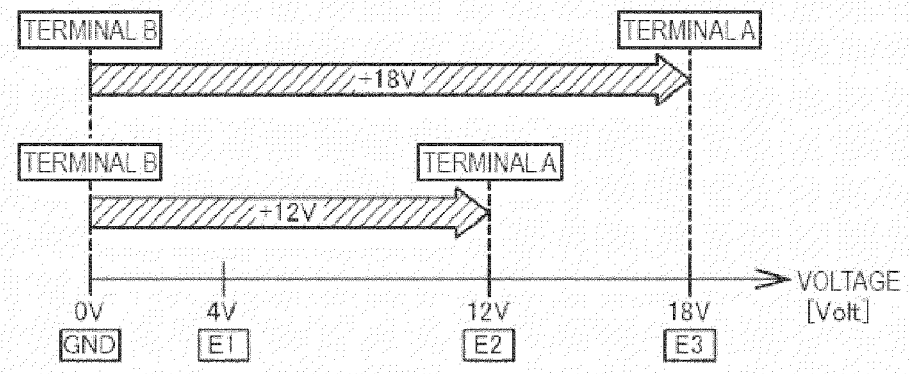
FIGS. 10A to 10C are explanatory views showing voltages that can be output by the drive voltage waveform generating circuit of the first modified example.
Figure 10B:
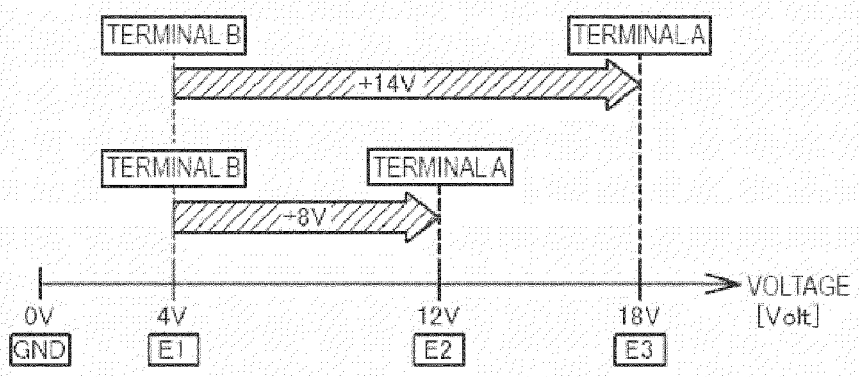
Figure 10C:
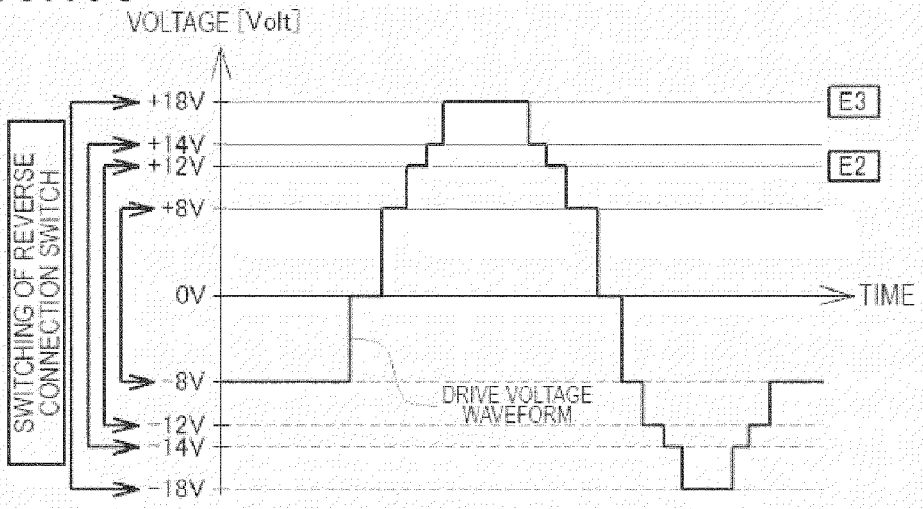

FIGS. 10A to 10C are explanatory views showing the state of applying voltage to a piezo element by using the drive voltage waveform generating circuit of the modified example. First, it is assumed that GND of the power supply group B is connected to the terminal B of the piezo element via the switch unit B. In this state, by the switching of the internal switches of the switch unit A, any of the power supplies in the power supply group A can be connected to the terminal A of the piezo element. In this case, since it is assumed that the power supply group A is provided with the power supply E3 generating a voltage of +18 V and the power supply E2 generating a voltage of +12 V, a voltage of +18 V or +12 V can be applied to the piezo element as shown in FIG. 10A.

On the other hand, when the terminal B of the piezo element is connected to the power supply E1 by the switching of the switch unit B, it is possible to apply the difference voltage between the voltage of the power supply E1 connected to the terminal B and the voltage of the power supply connected to the terminal A. Thus, it is possible to apply two voltages (+14 V and +8 V) each corresponding to the difference of voltages of the power supplies as shown in FIG. 10B.

FIG. 10C illustrates the state of applying a drive voltage waveform by using the drive voltage waveform generating circuit of the modified example. In the drive voltage waveform generating circuit of the modified example, as shown in FIGS. 10A and 10B, the voltages of +14 V and +8 V can also be generated in addition to the voltage +12 V of the power supply E2 and the voltage +18 V of the power supply E3. As a result, as illustrated in FIG. 10C, it is possible to apply a drive voltage waveform including these voltages. In FIG. 10C, these voltages are indicated by solid lines.

By the switching of the reverse connection switch 210 (refer to FIG. 9), since a power supply connected to the terminal A and a power supply connected to the terminal B can be exchanged, voltage applied to a piezo element can be changed to the opposite polarity voltage. Therefore, it is possible to apply, in addition to positive value voltages, a negative value voltage corresponding to each of the voltages as indicated by broken lines in FIG. 10C.

In this manner, also in the drive voltage waveform generating circuit of the modified example, a large number of voltages can be output. As a result, it is possible to apply an accurate drive voltage waveform by finely changing the voltages. As described above, one switch unit just has to be connected to power supplies of one group but does not have to be connected to all power supplies. Therefore, it is possible to decrease the number of switches of the switch unit to more simplify the device configuration.

C-2. Second Modified Example

Figure 11:
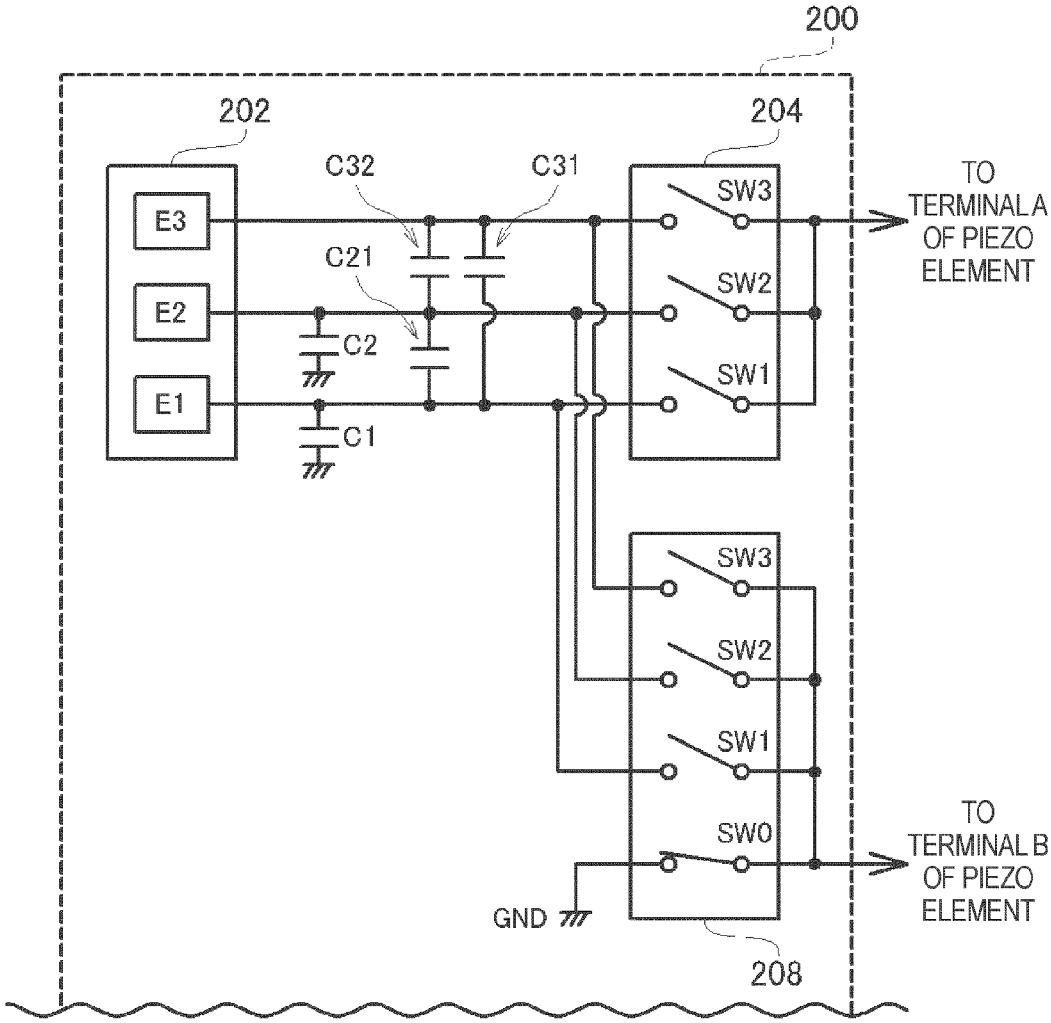
FIG. 11 is an explanatory view showing a drive voltage waveform generating circuit of a second modified example in which a capacitor is connected to each power supply of a power supply unit.

FIG. 11 is an explanatory view showing a drive voltage waveform generating circuit of a second modified example in which a capacitor is connected to each of the power supplies of the power supply unit. As shown in the drawing, in the drive voltage waveform generating circuit of the second modified example, capacitors C1 and C2 are respectively connected to the power supplies E1 and E2 of the power supply unit 202. A capacitor C21 is connected between the power supplies E2 and E1. Similarly, a capacitor C31 is connected between the power supplies E3 and E1. A capacitor C32 is connected between the power supplies E3 and E2. With the use of the circuit configuration, a charge charged into a piezo element can be regenerated into the capacitor. As a result, power consumption can be more suppressed.

Figure 12A:
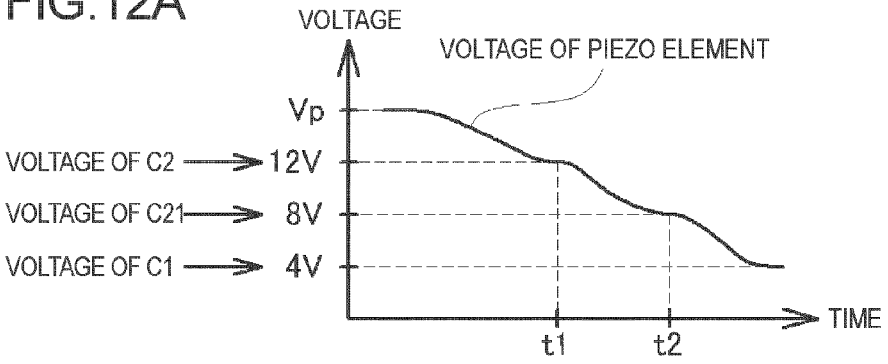
FIGS. 12A to 12C are explanatory views showing the state of regenerating a charge charged into a piezo element by using the drive voltage waveform generating circuit of the second modified example.
Figure 12B:
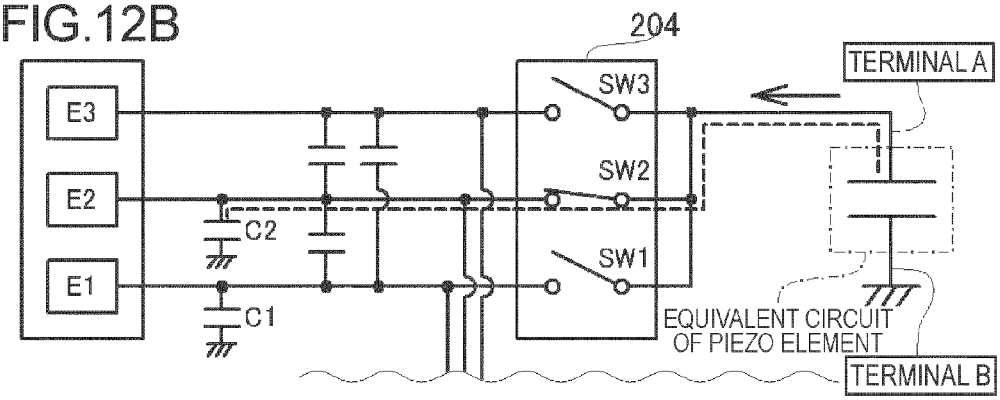
Figure 12C:
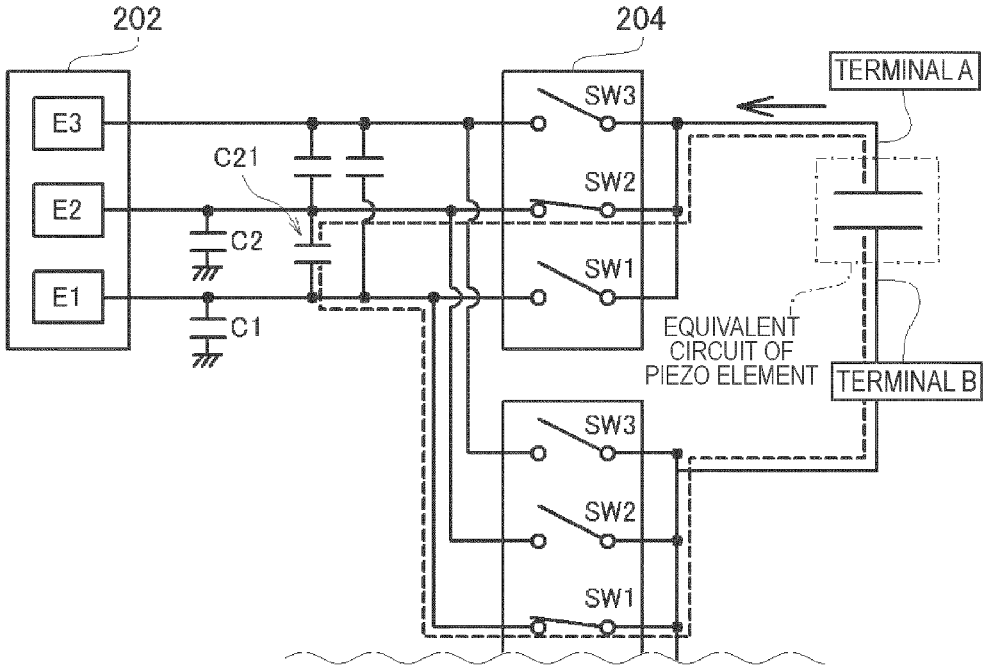

FIGS. 12A to 12C are explanatory views showing the state of regenerating a charge charged into a piezo element by using the drive voltage waveform generating circuit of the second modified example. FIG. 12A shows the state where the voltage of the piezo element changes along with the regeneration of the charge. It is assumed that the voltages of the power supplies E1 to E3 are +4 V, +12 V, and +18 V, respectively. As shown in the drawing, in the state before starting the regeneration of the charge, the voltage of the piezo element rises to a value indicated as "Vp" in the drawing by the application of voltage to the piezo element. Since the piezo element is a capacitive load, a charge is accumulated inside the piezo element in the state where voltage is applied.

In the drive voltage waveform generating circuit of the second modified example, the charge accumulated into the piezo element is regenerated into the capacitor as follows. As shown in FIG. 12B, the switch unit A204 is first operated to connect the terminal A of the piezo element with the capacitor C2. On the other hand, the switch unit B208 is operated to connect the terminal B of the piezo element with GND. In this state, since the voltage of the piezo element is higher than that of the capacitor C2 (about 12 V, which is substantially equal to the voltage of the power supply E2 of the power supply unit), the charge flows from the piezo element to the capacitor C2. Thus, the charge of the piezo element can be regenerated into the capacitor C2.

When the charge flows into the capacitor C2, the voltage of the piezo element gradually drops to the same voltage as that of the capacitor C2 before long (at the timing indicated as "t1" in the drawing) as shown in FIG. 12A. Since the charge does not flow from the piezo element in this state, the piezo element is connected at this time to the capacitor C21 disposed between the power supplies E1 and E2.

The voltage of the capacitor C21 is an intermediate voltage between the capacitor C2 and the capacitor C1 and therefore closer to the voltage of the piezo element than the voltage of the capacitor C2 is (refer to FIG. 12A). As shown in FIG. 12C, therefore, the switch units A204 and B208 are operated to connect both terminals of the piezo element to the capacitor C21, so that the charge is regenerated from the piezo element into the capacitor C21. With this operation, it is possible to regenerate the charge not only into the capacitor C2 or C1 but also into the capacitor C21 of the intermediate voltage.

When the charge is regenerated into the capacitor C21, since the voltage of the piezo element drops to the same voltage as that of the capacitor C21 before long (at the timing indicated as "t2" in the drawing), the piezo element is connected at this time to the capacitor C1. Thus, the charge of the piezo element can be regenerated into the capacitor C1.

The charge regenerated into the capacitor in this manner can be used again for applying voltage to the piezo element. That is, since the capacitors C1 and C2 are respectively connected in parallel to the power supplies E1 and E2 of the power supply unit (refer to FIG. 11), power can be supplied from not only the power supply but also the capacitor to the piezo element when the piezo element is connected to the power supply.

Further in the drive voltage waveform generating circuit of the modified example, since the terminal B of the piezo element can be connected to each of the power supplies, the charge can be regenerated not only into the capacitor C1 or C2 but also into the capacitors (capacitor C21 and the like) connected between the power supplies (refer to FIG. 12C) as described above. Power can also be supplied from these capacitors. In this manner, in the drive voltage waveform generating circuit of the second modified example, the charge supplied to the piezo element can be regenerated into the capacitor, and further the regenerated charge can be supplied again to the piezo element. Thus, since not all charge has to be supplied from the power supply unit every time voltage is applied to the piezo element, power consumption can be suppressed.

In addition, in the drive voltage waveform generating circuit of the modified example, the charge can be regenerated into the capacitors connected between the power supplies. Therefore, it is possible to suppress current flowing into the piezo element to more suppress power consumption. That is, in the drive voltage waveform generating circuit of the modified example, the voltage of the piezo element can be gradually dropped by connecting the piezo element to the capacitor connected between the power supplies. As a result, current generated when the voltage is dropped can be made small. In the example shown in FIG. 12A, the piezo element is changed from the state of being connected to the capacitor C2 to the state of being connected to the capacitor C21. Therefore, the change in voltage can be made small compared with the case where the piezo element is changed from the state of being connected to the capacitor C2 to the state of being connected to the capacitor C1. When the change in voltage is small, the current generated is also small in proportion to the change. Therefore, power consumption due to the current can be suppressed.

In the above description, the case where the charge of the piezo element is regenerated into the capacitor C21 is described as an example. However, the charge can also be regenerated into the capacitor C31 or C32, similarly to the capacitor C21, by operating the switch unit to connect the piezo element to the capacitor.

Also in the description, the capacitor and the power supply are directly connected to each other (refer to FIG. 11). However, a switch may be disposed between the capacitor and the power supply. In this case, it is possible, by turning off the switch, to avoid a risk that the charge flows to the power supply side when the charge of the piezo element is regenerated to decrease the regeneration efficiency.

While the fluid ejection devices according to the embodiment and modified examples have been described, the invention is not limited to the embodiment and modified examples. The invention can be embodied in various forms in a range not departing from the gist thereof. For example, the invention may be a printer (so-called line head printer or the like) provided with a larger ejection head. In such a printer, since the number of piezo elements is increased along with an increase in size of the ejection head, power consumption tends to increase. Therefore, the consumption power can be suppressed by applying the invention. In addition, since there is no necessity to use a large number of power supplies, and the circuit configuration can be decreased in size, the whole configuration of the printer can be made compact even when the ejection head is increased in size.

In the above-described embodiment and modified examples, the case of driving the piezo element of the inkjet printer is described as an example. However, the drive voltage waveform generating circuit described in the embodiment and modified examples can be applied to various devices driven in accordance with a voltage waveform. For example, the drive voltage waveform generating circuit can also be applied to a display device that can be driven by a voltage waveform, such as a liquid crystal panel or an organic EL panel. Even when the various devices are driven, power consumption can be suppressed. In addition, it is possible to apply an accurate drive voltage waveform to accurately control the devices. It is apparent that since there is no necessity to provide a large number of power supplies, the device configuration can be decreased in size.

What is claimed is:

1. A capacitive load driving circuit comprising:

a power supply unit which includes a plurality of power supplies which supply different voltages;

a piezo element having a first terminal and a second terminal, the piezo element receiving a voltage waveform and operating on the basis of a difference between voltages applied to the first terminal and the second terminal;

a first switching unit which selects one power supply among the plurality of power supplies so as to apply a selected voltage to first terminal;

a second switching unit which selects one power supply among the plurality of power supplies in the power supply unit so as to apply a second selected voltage to the second terminal; and a control circuit which controls the power supply unit, the first switching unit and the second switching unit.

2. The capacitive load driving circuit according to claim 1, wherein the capacitive load connects a output terminal the plurality of power supplies.

3. A fluid ejection device, comprising the capacitive load driving circuit according to claim 1.

4. A capacitive load driving circuit comprising:

a first power supply group which supplies different voltages using a plurality of first power supplies with different voltages;

a second power supply group which supplies different voltages using a plurality of second power supplies with different voltages;

a piezo element having a first terminal and a second terminal, the piezo element receiving a voltage waveform and operating on the basis of a difference between voltages applied to the first terminal and the second terminal;

a first switching unit selects one of the first power supplies among the first power supply first group on the basis of a difference between voltages applied to the first and second terminals;

a second switching unit selects one of the second power supplies among the second power supply group on the basis of a difference between voltages applied to the first and second terminals;

a control circuit to control the first power supply group, the second power supply group, the first switching unit, and the second switching unit; and a switch that connects to the first power supply selected by the first switching unit to the first terminal of the piezo element and which connects the second power supply selected by the second switching unit with the second terminal of the piezo element.

* * * * *